US009987847B2

(12) United States Patent
Takahashi

(10) Patent No.: US 9,987,847 B2
(45) Date of Patent: Jun. 5, 2018

(54) INKJET PRINTING APPARATUS AND A FLUSHING METHOD THEREFOR

(71) Applicant: SCREEN Holdings Co., Ltd., Kyoto (JP)

(72) Inventor: Susumu Takahashi, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days. days.

(21) Appl. No.: 15/213,982

(22) Filed: Jul. 19, 2016

(65) Prior Publication Data

US 2017/0021628 A1 Jan. 26, 2017

(30) Foreign Application Priority Data

Jul. 23, 2015 (JP) ..... 2015-145850

(51) Int. Cl.
*B41J 2/165* (2006.01)

(52) U.S. Cl.
CPC ..... *B41J 2/16517* (2013.01); *B41J 2/1652* (2013.01); *B41J 2/16526* (2013.01); *B41J 2/16585* (2013.01); *B41J 2002/1657* (2013.01); *B41J 2002/16529* (2013.01); *B41J 2002/16573* (2013.01)

(58) Field of Classification Search
CPC ..... B41J 2002/16529
See application file for complete search history.

(56) References Cited

U.S. PATENT DOCUMENTS

2007/0057983 A1* 3/2007 Kawaguchi ..... B41J 2/16526 347/9
2012/0081446 A1 4/2012 Usuda et al.
2012/0229565 A1* 9/2012 Yuda ..... B41J 2/16552 347/35
2013/0063507 A1 3/2013 Sasaki
2013/0257963 A1 10/2013 Yamamoto et al.
2014/0139577 A1* 5/2014 Sato ..... B41J 2/16526 347/12

(Continued)

FOREIGN PATENT DOCUMENTS

JP 2009-090533 A 4/2009
WO 2008/062809 A1 5/2008

OTHER PUBLICATIONS

Extended European Search Report dated Oct. 31, 2016, issued in European Patent Application No. 16179387.2.

*Primary Examiner* — Shelby Fidler
(74) *Attorney, Agent, or Firm* — Tomoki Tanida

(57) ABSTRACT

An inkjet printing apparatus includes a transport speed detector for detecting transport speed of a printing medium, an inkjet head having a plurality of discharge portions for discharging ink droplets from the discharge portions for printing, and a flushing controller for carrying out discrete flushing from the discharge portions. For an acceleration area of the printing medium where the transport speed detector detects an increase in transport speed before printing, a first discharge rate is set as discharge rate of the ink droplets per unit time for the discharge flushing. For a constant speed area of the printing medium where the transport speed detector detects a substantially constant transport speed during printing, a second discharge rate lower than the first discharge rate is set as discharge rate of the ink droplets per unit time for the discharge flushing.

16 Claims, 4 Drawing Sheets

(56) References Cited

U.S. PATENT DOCUMENTS

| | | | | |
|---|---|---|---|---|
| 2015/0321472 | A1* | 11/2015 | Koerner | B41J 2/165<br>347/14 |
| 2016/0339688 | A1* | 11/2016 | Sasaki | B41J 2/16526 |
| 2016/0355012 | A1* | 12/2016 | Katoh | B41J 2/16526 |

* cited by examiner

INKJET PRINTING APPARATUS AND A FLUSHING METHOD THEREFOR

CROSS-REFERENCE TO RELATED APPLICATIONS

This application claims priority to Japanese Patent Application No. 2015-145850 filed Jul. 23, 2015, The entire contents of which are hereby incorporated herein by reference in entirety.

BACKGROUND OF THE INVENTION (1) Field of the Invention

This invention relates to an inkjet printing apparatus for printing on a printing medium by discharging ink droplets thereto, and a flushing method therefor. More particularly, the invention relates to a flushing technique for discharging ink droplets in order to prevent defective discharge due to ink drying.

(2) Description of the Related Art

A known apparatus of this type includes an inkjet head for discharging ink droplets, and a controller for causing the ink droplets to be discharged from the inkjet head and controlling flushing (see Japanese Unexamined Patent Publication No. 2009-90533, for example).

The inkjet printing apparatus having the above construction further includes caps for covering discharge portions of the inkjet head in order to prevent drying of the ink droplets. When printing with this apparatus, these caps are first removed, and then transport of printing paper is started. The printing paper is accelerated toward a transport speed specified in printing conditions. After the transport speed reaches a printing speed and becomes substantially constant, printing is performed by discharging the ink droplets from the inkjet head to job areas of the printing paper.

While printing is started as described above, the controller carries out line flushing in advance to avoid missing nozzles due to defective discharge at the printing time. The following two techniques are typical examples used in the line flushing.

The first technique does not start printing immediately after the paper transport speed reaches the printing speed. Instead, it carries out line flushing (hereinafter called advance line flushing) for a pre-printing area, in which ink droplets are discharged from a plurality of discharge portions present in a row among a plurality of discharge portions of the inkjet head arranged perpendicular to the transport direction of the printing medium. Then, after start of the printing, it carries out star flushing (also called discrete flushing) in which the ink droplets are discharged discretely from each discharge portion of the inkjet head.

The second technique also carries out advance line flushing instead of starting printing immediately after the paper transport speed reaches the printing speed. After start of the printing and before printing pages to constitute a printed product, it carries out advance line flushing for a part corresponding to an area outside the pages.

However, the conventional examples with such constructions have the following problems.

With the conventional apparatus, whether the first technique or the second technique is employed, when a "followup printing" is carried out after printing on printing paper beforehand, the advance line flushing may be done to overlap the portion where printing has already been performed. Then, the ink becomes superfluous to impair drying performance, which may result in contamination of the interior of the apparatus caused by transfer through the rollers acting to transport the printing paper. The overlapping of the advance flushing may be avoided by inserting a flushing page for a subsequent advance line flushing at the time of followup printing. But this poses a problem of consuming extra printing paper.

Further, a post-processing machine such as for cutting printed paper, for example, is used to carry out a cutting process which uses page marks printed on upstream sides of page portions. At this time, the advance line flushing carried out before printing could be detected in error as page marks. Its prevention involves a problem of taking extra time and effort such as masking of the areas of advance line flushing.

SUMMARY OF THE INVENTION

This invention has been made having regard to the state of the art noted above, and its object is to provide an inkjet printing apparatus and a flushing method therefor, which can prevent contamination of the interior of the apparatus caused by flushing, without consuming extra printing paper, and enables a post-processing to be carried out without requiring extra time and effort.

The above object is fulfilled, according to this invention, by an inkjet printing apparatus for carrying out printing on a printing medium by discharging ink thereto, comprising a transport speed detector for detecting transport speed of the printing medium transported continuously; an inkjet head having a plurality of discharge portions arranged in a width direction of the printing medium for discharging ink droplets from the discharge portions to the printing medium to print on the printing medium; and a flushing controller having a function to control discharge of the ink droplets from the inkjet head for carrying out discrete flushing for discretely discharging the ink droplets from the discharge portions in order to prevent defective discharge from the discharge portions, wherein the flush controller functions in such a way that, for an acceleration area of the printing medium where the transport speed detector detects an increase in transport speed before printing, a first discharge rate is set as discharge rate of the ink droplets per unit time for the discharge flushing, and for a constant speed area of the printing medium where the transport speed detector detects a substantially constant transport speed during printing, a second discharge rate lower than the first discharge rate is set as discharge rate of the ink droplets per unit time for the discharge flushing.

According to this invention, when carrying out discrete flushing, the flushing controller sets for the acceleration area the first discharge rate as discharge rate of ink droplets per unit area in discrete flushing. The plurality of discharge portions of the inkjet head are covered by caps before start of printing. Ink drying usually proceeds in the discharge portions after these caps are removed and until arrival of the constant speed area. However, defective discharge can be prevented by carrying out the discrete flushing also for the acceleration area. Further, for the constant speed area, the flushing controller sets the second discharge rate lower than the first discharge rate, as discharge rate of ink droplets per unit area in discrete flushing. Consequently, defective discharge can be prevented while inhibiting lowering of printing quality for a printed product. As a result, contamination of the interior of the apparatus due to flushing can be prevented without consuming extra printing paper, and a post-processing can be carried out without requiring extra time and effort.

In this invention, the flushing controller may be arranged to increase discharge frequency of the ink droplets for the acceleration area.

With the flushing controller increasing discharge frequency of the ink droplets during acceleration of the transport speed of the printing medium, the discharge rate can be brought close to the rate at the time of carrying out advance line flushing. It can therefore fully prevent defective discharge even with discrete flushing.

In this invention, the flushing controller may be arranged to increase size and lower discharge frequency of the ink droplets for the acceleration area.

With the flushing controller increasing size of the ink droplets during acceleration of the transport speed of the printing medium, the discharge rate can be brought close to the rate at the time of carrying out advance line flushing. It can therefore fully prevent defective discharge even with discrete flushing.

In this invention, for a pre-printing area of the printing medium during a period before carrying out printing immediately after completion of the increase in the transport speed of the printing medium, which period occurs while the transport speed detector detects the substantially constant transport speed, the flushing controller may be arranged to set a third discharge rate between the first discharge rate and the second discharge rate as discharge rate of the ink droplets per unit time for the discharge flushing.

For the pre-printing area, the flushing controller sets the third discharge rate between the first discharge rate and the second discharge rate, as discharge rate of ink droplets per unit area in discrete flushing. Since this step can discharge a relatively large quantity of ink droplet also after completion of acceleration of the transport speed of the printing medium and until actual printing, defective discharge can be eliminated immediately before start of printing. Therefore, printing can be carried out with high quality.

In another aspect of this invention, a flushing method is provided for use with an inkjet printing apparatus, which comprises the steps of detecting transport speed of a printing medium transported continuously; and carrying out discrete flushing for discretely discharging ink droplets from an inkjet head having a plurality of discharge portions arranged in a width direction of the printing medium in order to prevent defective discharge of ink droplets from the discharge portions; wherein, for an acceleration area of the printing medium where transport speed increases before printing, the discrete flushing is carried out at a first discharge rate set as discharge rate of the ink droplets per unit time; and for a constant speed area of the printing medium where transport speed is substantially constant during printing, the discrete flushing is carried out at a second discharge rate set as discharge rate of the ink droplets per unit time to be lower than the first discharge rate.

According to this invention, when carrying out discrete flushing, the first discharge rate is set for the acceleration area as discharge rate of ink droplets per unit area in discrete flushing. The plurality of discharge portions of the inkjet head are covered by caps before start of printing. Ink drying usually proceeds in the discharge portions after these caps are removed and until arrival of the constant speed area. However, defective discharge can be prevented by carrying out the discrete flushing also for the acceleration area. Further, the second discharge rate lower than the first discharge rate is set for the constant speed area as discharge rate of ink droplets per unit area in discrete flushing. Consequently, defective discharge can be prevented while inhibiting lowering of printing quality for a printed product. Since no flushing page is used, contamination of the interior of the apparatus due to flushing can be prevented without consuming extra printing paper, and a post-processing can be carried out without requiring extra time and effort.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

A preferred embodiment of this invention will be described hereinafter with reference to the drawings.

Figure 1:
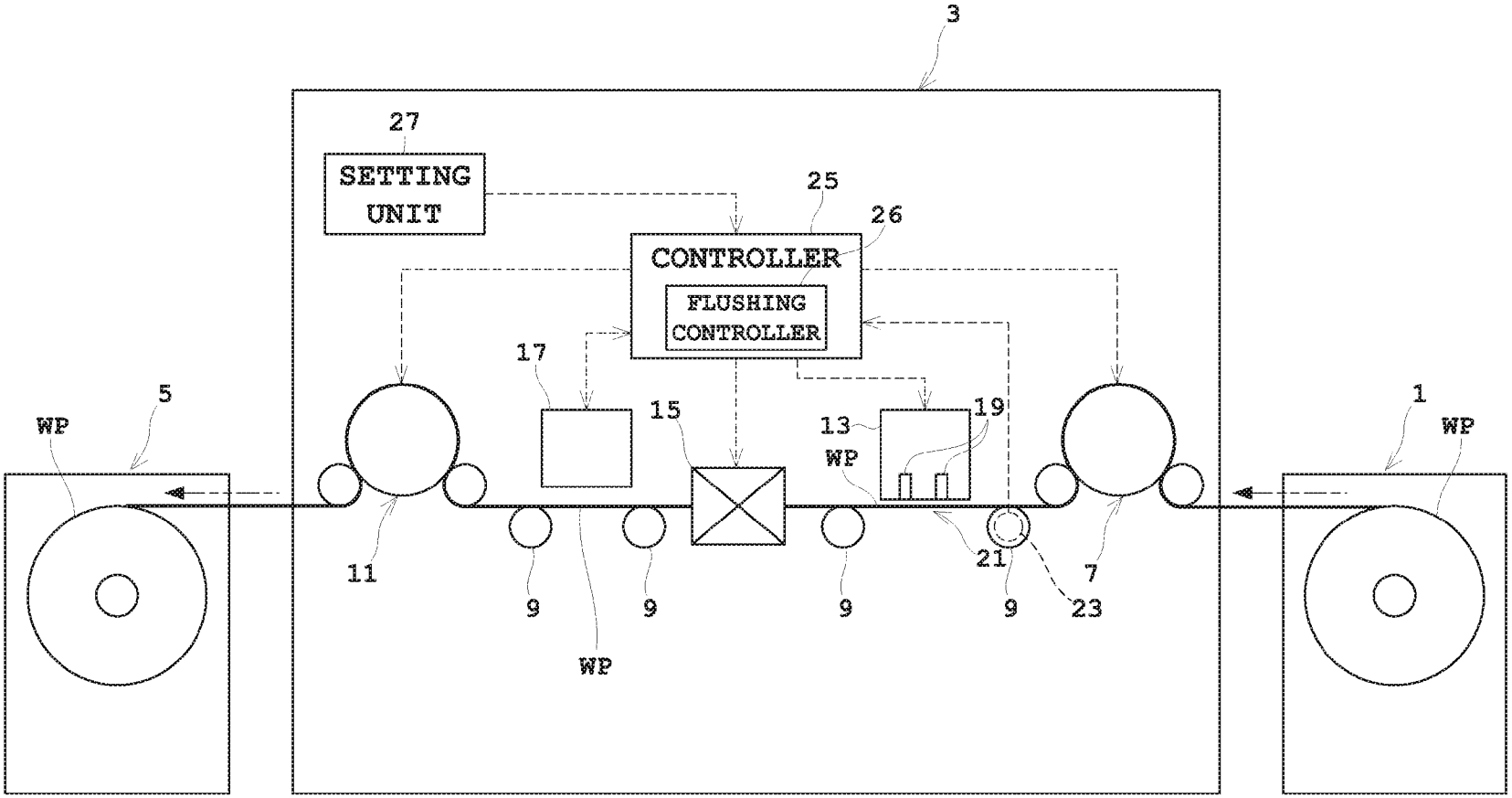
FIG. 1 is a schematic view showing an entire inkjet printing system according to this invention.
Figure 2:
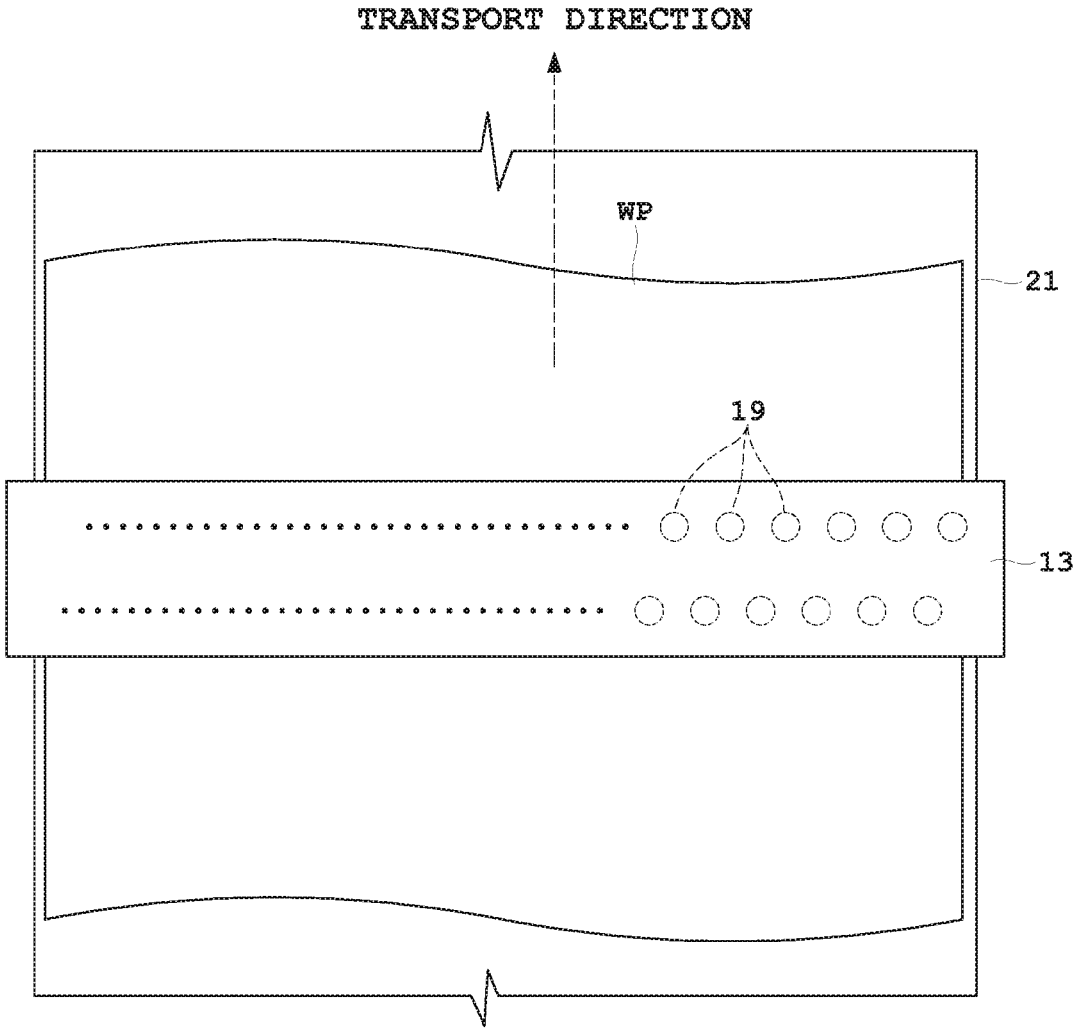
FIG. 2 is a plan view showing an inkjet head and adjacent components.

FIG. 1 is a schematic view showing an entire inkjet printing system according to this invention. FIG. 2 is a plan view showing an inkjet head and adjacent components.

The inkjet printing system according to this invention includes a paper feeder 1, an inkjet printing apparatus 3, and a takeup roller 5.

The paper feeder 1 holds web paper WP in a roll form to be rotatable about a horizontal axis, and unwinds the web paper WP to feed it to the inkjet printing apparatus 3. The inkjet printing apparatus 3 performs printing on the web paper WP fed thereto. The takeup roller 5 winds up the web paper WP printed by the inkjet printing apparatus 3 about a horizontal axis. Regarding the side from which the web paper WP is fed as upstream and the side to which the web paper WP is discharged as downstream, the paper feeder 1 is disposed upstream of the inkjet printing apparatus 3 while the takeup roller 5 is disposed downstream of the inkjet printing apparatus 3.

The inkjet printing apparatus 3 includes a drive roller 7 in an upstream position thereof for taking in the web paper WP from the paper feeder 1. The web paper WP unwound from the paper feeder 1 by the drive roller 7 is transported downstream toward the takeup roller 5 along a plurality of transport rollers 9. A drive roller 11 is disposed between the most downstream transport roller 9 and the takeup roller 5. This drive roller 11 feeds the web paper WP advancing on the transport rollers 9 toward the takeup roller 5.

The web paper WP noted above corresponds to the "printing medium" in this invention.

Between the drive roller 7 and drive roller 11, the inkjet printing apparatus 3 has an inkjet head 13, a drying unit 15, and an inspecting unit 17 arranged in the stated order from upstream to downstream. The drying unit 15 carries out a process for drying portions of the web paper WP printed by the inkjet head 13. The inspecting unit 17 carries out a process for inspecting printed areas of the web paper WP for any stains or omissions.

The inkjet head 13 has a plurality of discharge portions 19 for discharging ink droplets. The discharge portions 19 are arranged in a direction of width of the web paper WP. It is general practice to provide a plurality of inkjet heads 13 arranged along the transport direction of the web paper WP.

For example, four inkjet heads 13 are provided separately for black (K), cyan (C), magenta (M), and yellow (Y). However, in order to facilitate understanding of the invention, the following description will be made on an assumption that only one inkjet head 13 is provided.

As shown in FIG. 2, the inkjet head 13 is disposed to have a long axis thereof extending perpendicular to a transport path 21 along which the web paper WP is transported. The inkjet head 13 is disposed to have the plurality of discharge portions 19 spaced upward away from the upper surface of the web paper W. The inkjet head 13 has a length approximately corresponding to the width of the transport path 21. Although not shown in the drawings, the inkjet head 13 has caps movable between a state of closing the plurality of discharge portions 19 and a state of opening the discharge portions 19 to the ambient.

Of the plurality of transport rollers 9 noted above, the transport roller 9 disposed immediately upstream of the inkjet head 13 has a rotary encoder 23 attached to the rotary shaft thereof. Since the transport roller 9 is rotatable with movement of the web paper WP, this rotary encoder 23 outputs a pulse signal corresponding to the movement. That is, the rotary encoder 23 outputs a pulse signal corresponding to the transport speed of the web paper WP.

The drive rollers 7 and 11, inkjet head 13, drying unit 15, and inspecting unit 17 are operable all under control of a controller 25. The controller 25 includes a CPU, memory and so on, not shown, for sending to the inkjet head 13 printing data for printing on the web paper WP, and controlling drive speed of the drive rollers 7 and 11 according to a printing speed, a discharge speed of ink droplets at the inkjet head 13, and so on. The pulse signal of the rotary encoder 23 noted above is constantly inputted to the controller 25, which constantly calculates the transport speed and transport distance of the web paper WP from the pulse signal. The controller 25 causes the ink droplets to be discharged to intended positions on the web paper WB by adjusting timing of ink droplet discharge from the inkjet head 13 to the transport speed and transport distance calculated.

The rotary encoder 23 noted above corresponds to the "transport speed detector" in this invention.

The controller 25 has a setting unit 27 connected thereto. This setting unit 27 is operable by the operator to set printing conditions such as resolution and transport speed, and also discrete flushing conditions. The discrete flushing conditions here are set with reference to the printing conditions, and include sizes of ink droplets in discrete flushing for different areas of the web paper WP and discharge rates per unit area. The discrete flushing conditions are set beforehand by taking the printing conditions into account, and plural types of discrete flushing conditions are stored in memory. An arbitrary type of discrete flushing conditions may be selected from those types stored, and may be designated through the setting unit 27. As described in detail hereinafter, a flushing controller 26 included in the controller 25 controls discrete flushing in response to the discrete flushing conditions and transport speeds designated.

Figure 3:
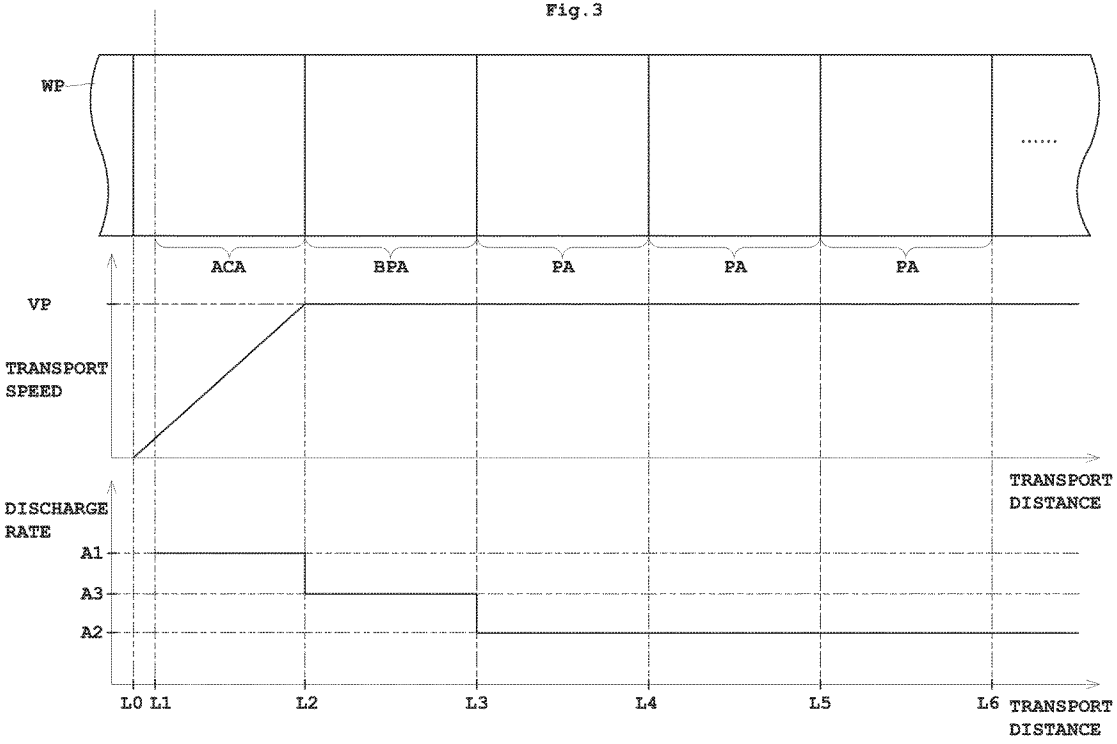
FIG. 3 is a time chart of transport speeds and discharge rates in discrete flushing.

The details of discrete flushing will now be described with reference to FIG. 3. FIG. 3 is a time chart of transport speeds and discharge rates in discrete flushing.

In FIG. 3, the horizontal axis represents transport distances of the web paper WP, the vertical axis of the upper time chart represents transport speeds, and the vertical axis of the lower time chart represents discharge rates of the ink droplets. Sign ACA on the web paper WP denotes an acceleration area which is a portion of the web paper WP transported during an increase in the transport speed of the web paper WP. Sign BPA denotes a pre-job area which is a portion of the web paper WP transported after an end of the increase in the transport speed of the web paper WP until a start of printing. Sign PA denotes job areas which are portions of the web paper WP transported during actual printing.

The controller 25 starts transporting the web paper WP at a time of transport distance L0 (distance=0) at which the transport speed is zero 0, and attains transport distance L1 which corresponds to a stabilizing distance from the transport distance L0. The acceleration area ACA is an area from this transport distance L1 to transport distance L2 at which the transport speed reaches a printing velocity VP specified in the printing conditions. The pre-job area BPA is an area from the transport distance L2 at which the transport speed reaches the printing velocity VP to transport distance L3. Through this pre-job area BPA, the transport speed is stabilized. The job areas PA are areas for actual printing on the web paper WP, and are set over a plurality of areas downstream of the pre-job area BPA. Specifically, each of transport distances L3-L4, L4-L5, L5-L6, and so on defines a job area PA. The above stabilizing distance is from transport distance L0 to transport distance L1, and is a transport distance required until elimination of an instability such as wobbling of the web paper WP occurring during transport.

The above pre-job area BPA corresponds to the "pre-printing area" in this invention. The pre-job area BPA and job areas PA correspond to the "constant speed area" in this invention.

Preferably, the discrete flushing conditions noted above are set for each area as follows, for example.

For the acceleration area ACA, the discharge rate per unit area of ink droplets is set to a first discharge rate A1, and for each job area PA, the discharge rate per unit area of ink droplets is set to a second discharge rate A2. For the pre-job area BPA, the discharge rate per unit area of ink droplets is set to a third discharge rate A3. The relationship between the discharge rates per unit area for the respective areas is first discharge rate A1>third discharge rate A3>second discharge rate A2.

Preferably, after satisfying the above relationship between the discharge rates per unit area, the size and discharge frequency of ink droplets are set as follows, for example.

For the acceleration area ACA, since there is no influence on printing quality, the discharge frequency of ink droplets is set high, or the size of ink droplets is set large. Such setting can achieve a discharge rate close to the rate at the time of carrying out advance line flushing in conventional examples, and can therefore fully prevent defective discharge even with discrete flushing.

For the job areas PA among the constant speed areas, the size of ink droplets is set smallest and the discharge frequency is also set lowest. However, it is preferable to determine a size and discharge frequency of ink droplets in a range not adversely affecting printing quality in the job areas PA. For the pre-job area BPA which is one other constant speed area, the size of ink droplets is smaller than that for the acceleration area ACA and larger than that for the job areas PA, or the discharge frequency is lower than that for the acceleration area ACA and higher than that for the job areas PA.

Figure 4:
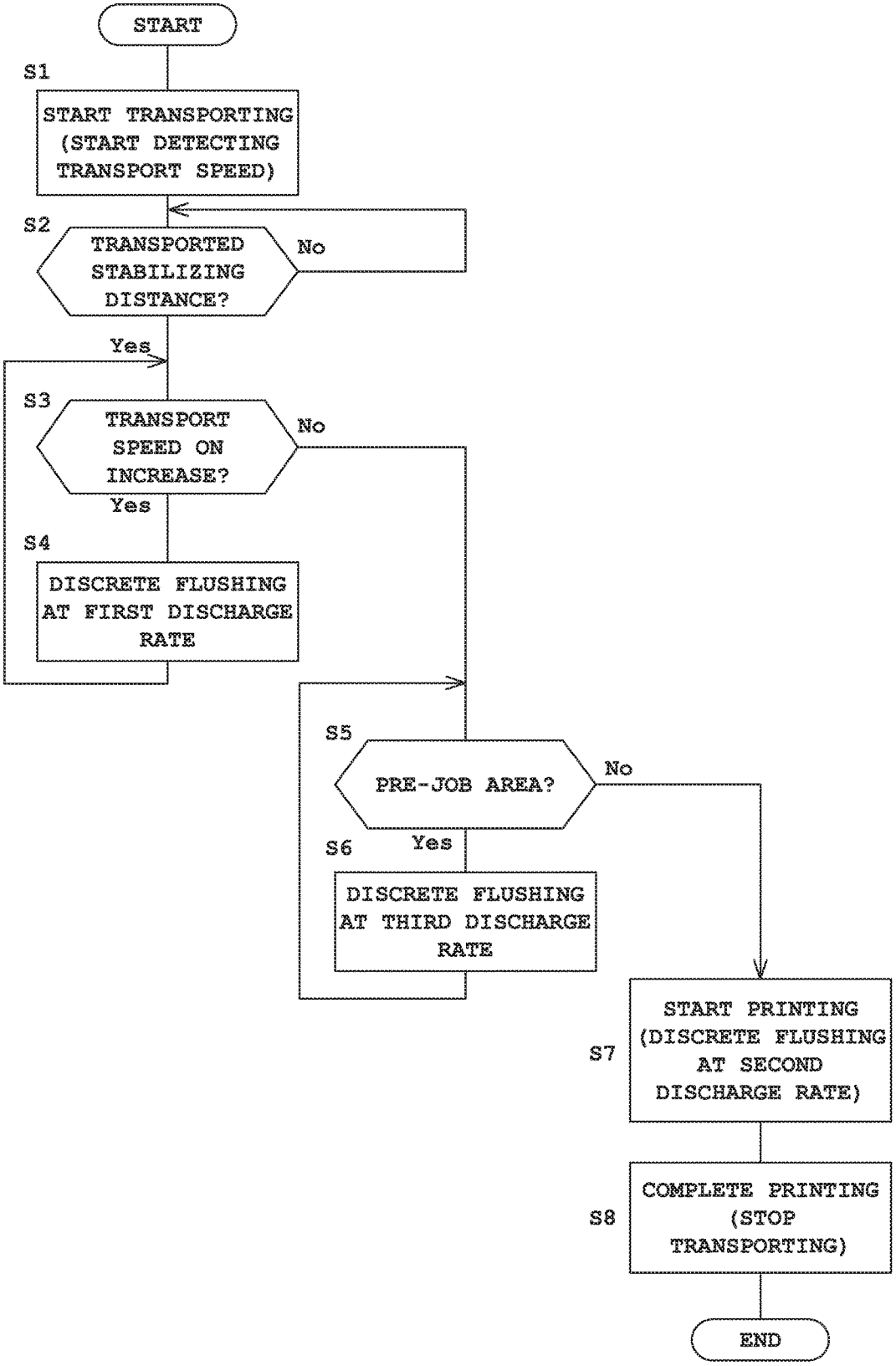
FIG. 4 is a flow chart showing operation.

Next, operation of the above inkjet printing system will be described with reference to FIG. 4. FIG. 4 is a flow chart showing operation. It is assumed here that the operator has already set through the setting unit 27 printing conditions for a product with job areas PA to be printed from now on, and has already selected through the setting unit 27 discrete flushing conditions appropriate to the printing conditions.

Step S1

The controller 25 removes the caps, not shown, from the inkjet head 13, and starts transporting the web paper WP by operating the drive rollers 7 and 11 according to the printing conditions set.

Step S2

The process is branched upon completion of transport through the stabilizing distance. The above step S1 and this step S2 correspond to the process between transporting distance L0 and transporting distance L1 in FIG. 3.

Steps S3 and S4

The flushing controller 26 branches the process based on whether the transport speed is on the increase, which is determined from the pulse signal of the rotary encoder 23. When the transport speed is on the increase, step S4 is executed to carry out discrete flushing at the first discharge rate. These steps S3 and S4 correspond to the process between transport distance L1 and transport distance L2 in FIG. 3.

Steps S5 and S6

When the pulse signal of the rotary encoder 23 indicates completion of the increase in the transport speed, the flushing controller 26 branches the process based on whether the transport distance indicates the pre-job area BPA preceding the job areas PA. When the pre-job area BPA is indicated, step S6 is executed to carry out discrete flushing at the third discharge rate. These steps S5 and S6 correspond to the process between transport distance L2 and transport distance L3 in FIG. 3.

Step S7

When the pulse signal of the rotary encoder 23 indicates completion of the increase in the transport speed, and the transport distance indicates a job area PA, the flushing controller 26 carries out discrete flushing at the second discharge rate. This step S7 corresponds to each of the processes between transport distance L3 and transporting distance L4, transport distance L4 and transport distance L5, transport distance L5 and transport distance L6, and so on.

Step S8

The controller, when it determines from the transport distance indicated by the pulse signal of the rotary encoder 23 that the process is completed for all the job areas PA, operates the drive rollers 9 and 11 to stop transporting the web paper WP.

According to this embodiment, when carrying out discrete flushing, the flushing controller 26 sets for the acceleration area ACA the first discharge rate A1 as discharge rate of ink droplets per unit area in discrete flushing. The plurality of discharge portions 19 of the inkjet head 13 are covered by the caps before start of printing. Ink drying usually proceeds in the discharge portions 19 after these caps are removed and until arrival of the pre-job area BPA and job areas PA which are constant speed areas. However, defective discharge can be prevented by carrying out the discrete flushing also for the acceleration area ACA. Further, for the job areas PA among the pre-job area BPA and job areas PA which are constant speed areas, the flushing controller 26 sets the second discharge rate A2 lower than the first discharge rate A1, as discharge rate of ink droplets per unit area in discrete flushing. Consequently, defective discharge can be prevented while inhibiting lowering of printing quality for a printed product. Since no flushing page is used, contamination of the interior of the apparatus due to flushing can be prevented without consuming extra printing paper, and a post-processing can be carried out without requiring extra time and effort.

Further, for the pre-job area BPA, the flushing controller 26 sets the third discharge rate A3 between the first discharge rate A1 and the second discharge rate A2, as discharge rate of ink droplets per unit area in discrete flushing. Since this step can discharge a relatively large quantity of ink droplet immediately before the job areas PA for printing, defective discharge can be eliminated immediately before start of printing. Therefore, printing in the job areas PA can be carried out with high quality.

This invention is not limited to the foregoing embodiment, but may be modified as follows:

(1) In the foregoing embodiment, the rotary encoder 23 has been described as an example of transport speed detector. This invention is not limited to such construction as long as the transport speed of web paper WP can be detected.

(2) In the foregoing embodiment, the third discharge rate A3 is set to the discrete flushing for the pre-job area BPA. Depending on printing conditions or the characteristics of ink, this discharge rate may be made equal to the first discharge rate A1 for the acceleration area ACA. Alternatively, depending on printing conditions or the characteristics of ink, discrete flushing may be carried out for the pre-job area BPA at the second discharge rate A2 set for the job areas PA.

(3) The foregoing embodiment has been described taking an apparatus that performs simplex printing for example, but this invention is applicable also to an apparatus that performs duplex printing. With the latter apparatus, when pages for flushing are provided between job areas PA, line flushing may be carried out for one side, and the above-described discrete flushing for the other side. This can prevent defective discharge resulting from leaving one side blank, in order to avoid inconveniences such as swelling and defacement of web paper WP which may result from line flushing done for both sides.

This invention may be embodied in other specific forms without departing from the spirit or essential attributes thereof and, accordingly, reference should be made to the appended claims, rather than to the foregoing specification, as indicating the scope of the invention.

What is claimed is:

1. An inkjet printing apparatus for carrying out printing on a printing medium by discharging ink thereto, comprising:

a transport speed detector for detecting transport speed of the printing medium transported continuously and on which printing has already been performed;

an inkjet head having a plurality of discharge portions arranged in a width direction of the printing medium for discharging ink droplets from the discharge portions to the printing medium to print on the printing medium; and a flushing controller having a function to control discharge of the ink droplets from the inkjet head for carrying out star flushing for discretely discharging the ink droplets from the discharge portions in order to prevent defective discharge from the discharge portions, wherein the flush controller functions in such a way that, for an acceleration area of the printing medium where the transport speed detector detects an increase in transport speed before printing, a first discharge rate is set as discharge rate of the ink droplets per unit time for the star flushing, and for a constant speed area of the printing medium where the transport speed detector detects a substantially constant transport speed during printing, a second discharge rate lower than the first discharge rate is set as discharge rate of the ink droplets per unit time for the star flushing.

2. The inkjet printing apparatus according to claim 1, wherein the flushing controller is arranged to increase discharge frequency of the ink droplets for the acceleration area.

3. The inkjet printing apparatus according to claim 2, wherein, for a pre-printing area of the printing medium during a period before carrying out printing immediately after completion of the increase in the transport speed of the printing medium, which period occurs while the transport speed detector detects the substantially constant transport speed, the flushing controller is arranged to set a third discharge rate between the first discharge rate and the second discharge rate as discharge rate of the ink droplets per unit time for the discharge flushing.

4. The inkjet printing apparatus according to claim 2, wherein the transport speed detector is a rotary encoder attached to a transport roller by which the printing medium is transported.

5. The inkjet printing apparatus according to claim 1, wherein the flushing controller is arranged to increase size of the ink droplets for the acceleration area.

6. The inkjet printing apparatus according to claim 5, wherein, for a pre-printing area of the printing medium during a period before carrying out printing immediately after completion of the increase in the transport speed of the printing medium, which period occurs while the transport speed detector detects the substantially constant transport speed, the flushing controller is arranged to set a third discharge rate between the first discharge rate and the second discharge rate as discharge rate of the ink droplets per unit time for the discharge flushing.

7. The inkjet printing apparatus according to claim 5, wherein the transport speed detector is a rotary encoder attached to a transport roller by which the printing medium is transported.

8. The inkjet printing apparatus according to claim 1, wherein, for a pre-printing area of the printing medium during a period before carrying out printing immediately after completion of the increase in the transport speed of the printing medium, which period occurs while the transport speed detector detects the substantially constant transport speed, the flushing controller is arranged to set a third discharge rate between the first discharge rate and the second discharge rate as discharge rate of the ink droplets per unit time for the discharge flushing.

9. The inkjet printing apparatus according to claim 1, wherein the transport speed detector is a rotary encoder attached to a transport roller by which the printing medium is transported.

10. The inkjet printing apparatus according to claim 1, wherein the printing is performed on both of one side and another side of the printing medium, the star flushing is carried out on the other side of the printing medium, and line flushing is carried out on the one side.

11. A flushing method for use with an inkjet printing apparatus, comprising the steps of:

detecting transport speed of the printing medium transported continuously and on which printing has already been performed; and carrying out star flushing for discretely discharging ink droplets from an inkjet head having a plurality of discharge portions arranged in a width direction of the printing medium in order to prevent defective discharge of ink droplets from the discharge portions, wherein, for an acceleration area of the printing medium where transport speed increases before printing, the star flushing is carried out at a first discharge rate set as discharge rate of the ink droplets per unit time, and for a constant speed area of the printing medium where transport speed is substantially constant during printing, the star flushing is carried out at a second discharge rate set as discharge rate of the ink droplets per unit time to be lower than the first discharge rate.

12. The flushing method according to claim 11, wherein the step of carrying out the discrete flushing at the first discharge rate increases discharge frequency of the ink droplets for the acceleration area.

13. The flushing method according to claim 12, wherein, for a pre-printing area of the printing medium during a period before carrying out printing immediately after completion of the increase in the transport speed of the printing medium, which period occurs while the transport speed is substantially constant, the step of carrying out the discrete flushing at the second discharge rate sets a third discharge rate between the first discharge rate and the second discharge rate as discharge rate of the ink droplets per unit time for the discharge flushing.

14. The flushing method according to claim 11, wherein the step of carrying out the discrete flushing at the first discharge rate increases size of the ink droplets for the acceleration area.

15. The flushing method according to claim 14, wherein, for a pre-printing area of the printing medium during a period before carrying out printing immediately after completion of the increase in the transport speed of the printing medium, which period occurs while the transport speed is substantially constant, the step of carrying out the discrete flushing at the second discharge rate sets a third discharge rate between the first discharge rate and the second discharge rate as discharge rate of the ink droplets per unit time for the discharge flushing.

16. The flushing method according to claim 11, wherein, for a pre-printing area of the printing medium during a period before carrying out printing immediately after completion of the increase in the transport speed of the printing medium, which period occurs while the transport speed is substantially constant, the step of carrying out the discrete flushing at the second discharge rate sets a third discharge rate between the first discharge rate and the second discharge rate as discharge rate of the ink droplets per unit time for the discharge flushing.

* * * * *